US005813420A

United States Patent [19]

Sussman

[11] Patent Number: 5,813,420

[45] Date of Patent: Sep. 29, 1998

[54] COSMETIC MAKE-UP KIT WITH REPLACEABLE MODULES

[76] Inventor: Morris Sussman, 50 Doxsee Dr., Freeport, N.Y. 11520

[21] Appl. No.: 944,861

[22] Filed: Oct. 6, 1997

[51] Int. Cl.[6] ..... A45D 33/26

[52] U.S. Cl. ..... 132/294; 206/581; 206/560; 132/315

[58] Field of Search ..... 132/294, 295, 132/297, 314, 315, 298, 300, 313, 317; 206/581, 564, 560, 456, 235; 434/100, 407, 377

[56] References Cited

U.S. PATENT DOCUMENTS

| | | | |
|---|---|---|---|
| 1,682,534 | 8/1928 | Martinat | 132/297 |
| 2,461,177 | 2/1949 | Prestien | 206/581 |
| 4,421,127 | 12/1983 | Geer | 132/294 |
| 4,589,430 | 5/1986 | Sussman | 32/294 |
| 4,826,014 | 5/1989 | Schefer | 206/581 |
| 4,936,324 | 6/1990 | Chen | 132/294 |
| 5,005,697 | 4/1991 | Jimbo et al. | 132/294 |
| 5,092,354 | 3/1992 | Pacelli, Jr. | 132/294 |
| 5,353,947 | 10/1994 | Zinnbauer et al. | 206/581 |
| 5,713,471 | 2/1998 | Gueret | 132/294 |

FOREIGN PATENT DOCUMENTS

| | | | |
|---|---|---|---|
| 695089 | 9/1930 | France | 132/294 |
| 4141249 | 6/1993 | Germany | 132/294 |
| 8807825 | 10/1988 | WIPO | 132/294 |

*Primary Examiner*—Todd E. Manahan
*Assistant Examiner*—Eduardo C. Robert
*Attorney, Agent, or Firm*—Michael Ebert

[57] ABSTRACT

A make-up kit housing an assortment of different cosmetics, each of which is stored in a miniature module. The kit includes a case having a plurality of module sites, each site being defined by a set of guide pins anchored on the base of the case to abut the sides of the module seated at the site. Hinged to the case is a frame plate which swings down to engage the upper edge of the case to lock the modules therein. The plate is provided with a plurality of openings, each framing a respective module seated at a site to expose the cosmetic therein. To replace a module whose cosmetic is exhausted, the frame plate is raised and a fresh module is substituted at the site for the exhausted module.

8 Claims, 4 Drawing Sheets

COSMETIC MAKE-UP KIT WITH REPLACEABLE MODULES

BACKGROUND OF INVENTION

1. Field of Invention

This invention relates generally to the packaging of cosmetics, and more particularly to a make-up kit housing an assortment of different cosmetics.

2. Status of Prior Art

In the sense this term is used in the field of cosmetics, the term make-up takes in the various cosmetics employed to color and beautify the face. Included, therefore, in make-up are lipstick, blusher, eyelash, mascara and eye shadow, as well as pressed powders. In order to apply these cosmetics, various tools or applicators are required, such as brushes and pencils.

Because of the assortment of cosmetic items required by the modern woman to do justice to her make-up, at home these items are usually deployed on a mirrored dressing table. But when away from home, the same woman tries to take along the various items she needs for proper make-up, using her hand bag as a carry all.

This presents a practical problem; for in the typical handbag, one finds scattered therein various small compacts, cosmetic containers of various sorts and cosmetic applicators. The same handbag may also contain a handkerchief, a change purse, a wallet and other non-cosmetic items.

While some women take pains to organize the contents of their handbag so as to make the various items therein readily accessible on demand, more typically the items are in a jumble, and when a woman wishes to make up, say in a restaurant restroom, or elsewhere away from home, she has difficulty in extracting from her handbag the cosmetic items necessary for make up. Some women cope with this problem by taking along only a very limited number of basic cosmetic items, but this is not a satisfactory solution; for then the make-up is deficient and the woman is not at her best.

While attempts have heretofore been made to provide a compact, multi-cellular make-up kit, each cell of which contains a particular cosmetic item, such as blusher or mascara, this kit has only a short term utility; for when a given item is exhausted, it cannot be replenished. Since in the course of making up on a given occasion with an assortment of cosmetic items, one does not use the same amount of each item in the multi-cellular kit, some items last much longer than others. As a consequence, a point is reached with a kit of this type where there is no more mascara, or where a little blusher is left, yet there is a plentiful supply of other items.

To overcome this problem, there is disclosed in my prior 1986 Pat. No. 4,589,430 entitled "Cosmetic Kit with Replaceable Holders" a make-up kit for storing an assortment of different cosmetics and applicators therefor in a highly compact case having a hinged cover. Nested in the case is a rectangular tray divided by a ridge into a front compartment for accommodating the applicators and a rear compartment for receiving a row of replaceable holders, each carrying a supply of a different cosmetic, such as pressed powder or mascara.

The holders are dimensioned to snap into the rear compartment and to fit snugly between the ridge and the rear wall of the tray. Formed on the rear end of each holder is a tongue which projects from the base and is socketed within a complementary slot in the rear wall of the tray. The top of the holder includes a projecting front ledge which overlies the ridge to define a thumb piece to facilitate removal of the holder from its compartment. Below the ledge on the front end of the holder is a detent which engages the side of the ridge to retain the holder in place.

Though a make-up kit of the type disclosed in my prior patent supplies a user with an assortment of different cosmetics, it has certain practical drawbacks. Because the holders containing the cosmetics must be snapped into a compartment and to fit snugly therein, some users find it difficult to carry out this operation. And the structure of the kit and of the holders that snap therein are such as to make it relatively expensive to manufacture.

A typical cosmetic section of a department store or a retail establishment that specializes in cosmetics carries on its shelves a broad range of cosmetics of various types and brands. The merchandising of cosmetics is complicated by the fact that the typical consumer is a woman who prides herself on her appearance and is not likely to purchase a cosmetic that she had not previously used without first trying it out to determine whether the product satisfies her needs in regard to color, fragrance, absorption, smoothness and other characteristics related to the nature of the cosmetic.

The retail cosmetic field is highly competitive, and many brands of a particular cosmetic, such as lip gloss, vie for a consumer's attention. In order to promote the sale of cosmetics by making it possible for a consumer to test a cosmetic to see whether it meets with her personal requirements, many cosmetic retail establishments provide the consumer with a small sample of the cosmetic. To this end, placed on the counter are open jars and other containers of various cosmetics available for purchase, from which the consumer or the sales clerk may extract a small sample which the consumer can then apply to her skin and examine.

Open cosmetic jars an other containers to which frequent access is had present a serious problem in regard to health and hygiene in an age when some consumers who are given access to these containers may be suffering from contagious diseases. It is for this reason that the use of a finger to extract a cosmetic sample from an open jar is interdicted, and the common practice is to use a sterile cotton swab as a sampling tool. But even then with open cosmetic jars being in constant use by a stream of potential purchasers, sterile conditions are not assured. Moreover, in a busy store, the need to provide on a cosmetic counter many sampling jars reduce the amount of space available for sales transactions.

SUMMARY OF INVENTION

In view of the foregoing, the main object of this invention is to provide a make-up which housing an assortment of different cosmetics, each of which is stored in a miniature wafer-like module.

A significant feature of this invention is that the modules which are seated in the case of the kit are dropped into place, thereby avoiding the need for snap-in expedients as with the cosmetic holders disclosed in my prior patent.

More particularly, an object of this invention is to provide a kit of the above type in which each cosmetic module seated in the base is locked therein by a frame plate which exposes the cosmetics and holds the module in place.

Also an object of the invention is to provide a kit of the above type in which a module whose cosmetic supply is exhausted can be quickly replaced by a fresh module.

Yet another object of the invention is to provide a kit of the above type which can be mass produced at relatively low cost.

Briefly stated, these objects are accomplished by a make-up kit housing an assortment of different cosmetics, each of which is stored in a miniature module. The kit includes a case having a plurality of module sites, each site being defined by a set of guide pins anchored on the base of the case to abut the sides of the module seated at the site. Hinged to the case is a frame plate which swings down to fit onto the upper edge of the case to lock the modules therein. The plate is provided with a like plurality of openings, each framing a respective module to expose the cosmetic therein. To replace a module whose cosmetic is exhausted, the frame plate is raised and a fresh module is substituted at the site for the exhausted module.

BRIEF DESCRIPTION OF DRAWINGS

For a better understanding of the invention, as well as other objects and features thereof, reference is made to the accompanying drawings wherein.

DESCRIPTION OF DRAWING

First Embodiment

Figure 1:
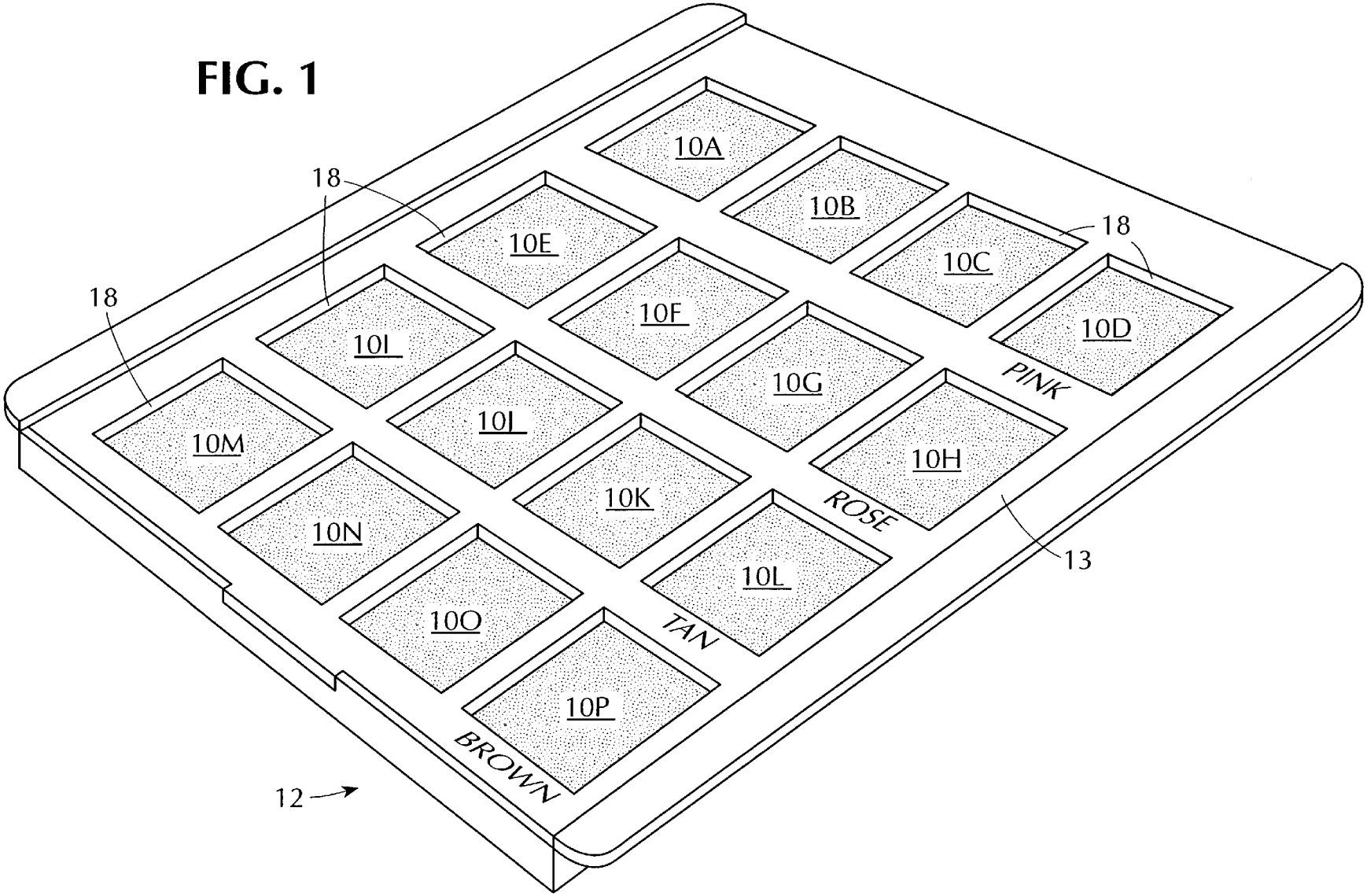
FIG. 1 is a perspective view of a make-up kit in accordance with the invention having an array of modules providing samples of different shades of a cosmetic face powder.

In the embodiment of a make-up kit shown in FIG. 1, there is housed in this kit an array of sixteen cosmetic modules 10A to 10P, each containing a different shade of a pressed face powder. The array consists of four parallel rows, each having a series of four modules.

The purpose of this kit which is to assist in the merchandising of face powders is to provide a prospective customer with a supply of different shades of the powders. In this way the prospect can sample these shades to determine which she wishes to purchase.

Thus the first row of modules (10A to 10D) may present different shade of pink face powder, the second row (10E to 10H) different shades of rose colored powder, the third row different shades of tan, and the fourth row (10M to 10P) different shades of brown. It is to be understood however that this sampling kit is by way of example only and that the modules may contain an assortment of other types of cosmetics.

Figure 4:
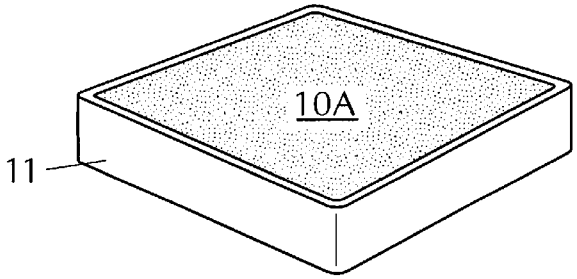
FIG. 4 is a separate view of one of the cosmetic modules.

As shown in FIG. 4 in connection with module 10A, each module consists of a miniature square tray 11 of tin, aluminum or other suitable metal having a block of cosmetic stored therein.

An important feature of the present invention is that when the supply of cosmetic in a module is exhausted, it may be quickly replaced in the kit by a fresh module.

Figure 2:
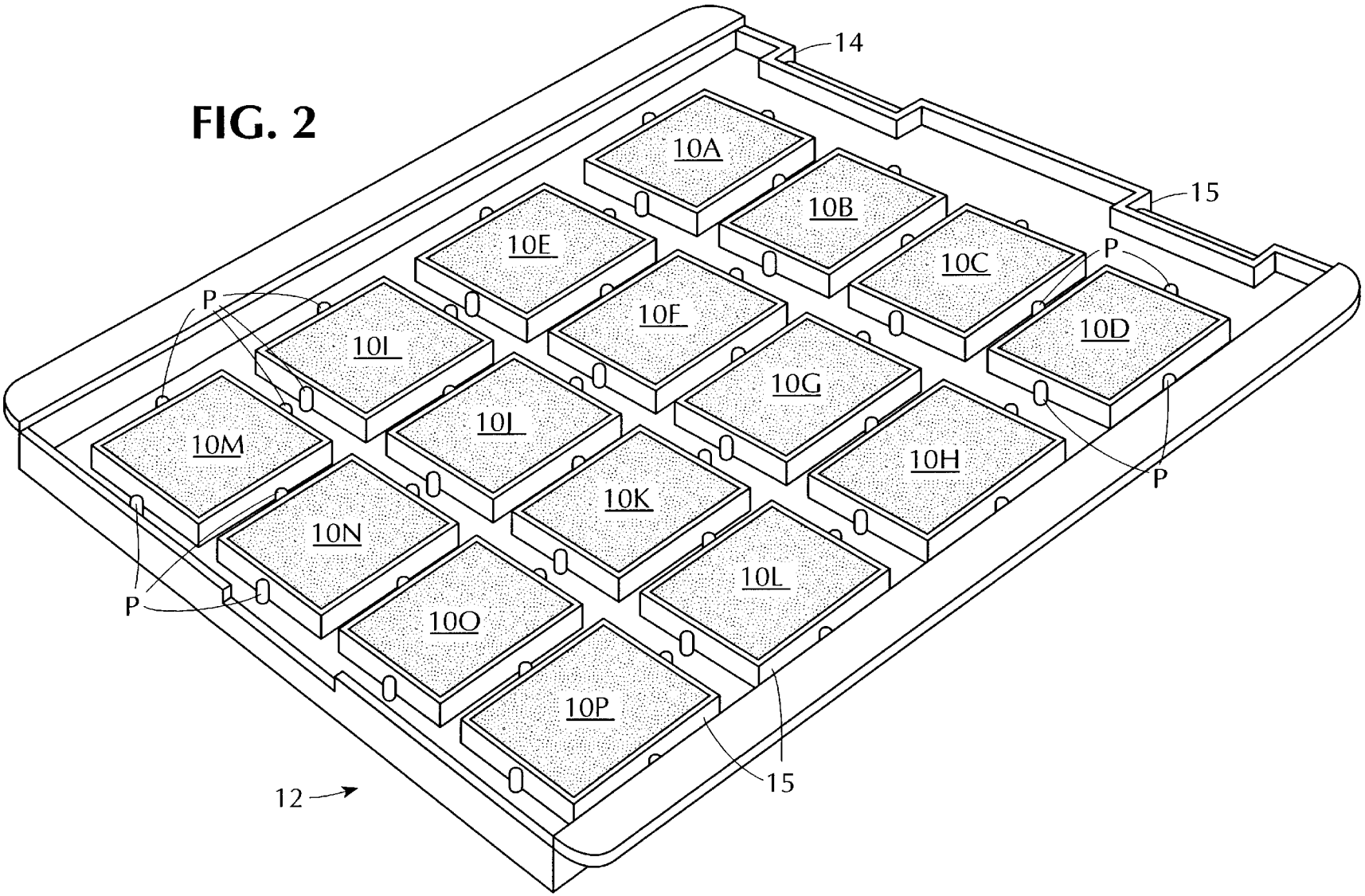
FIG. 2 illustrates the case of the kit shown in FIG. 1 with the frame plate hinged thereto removed to expose the interior of the case.
Figure 3:
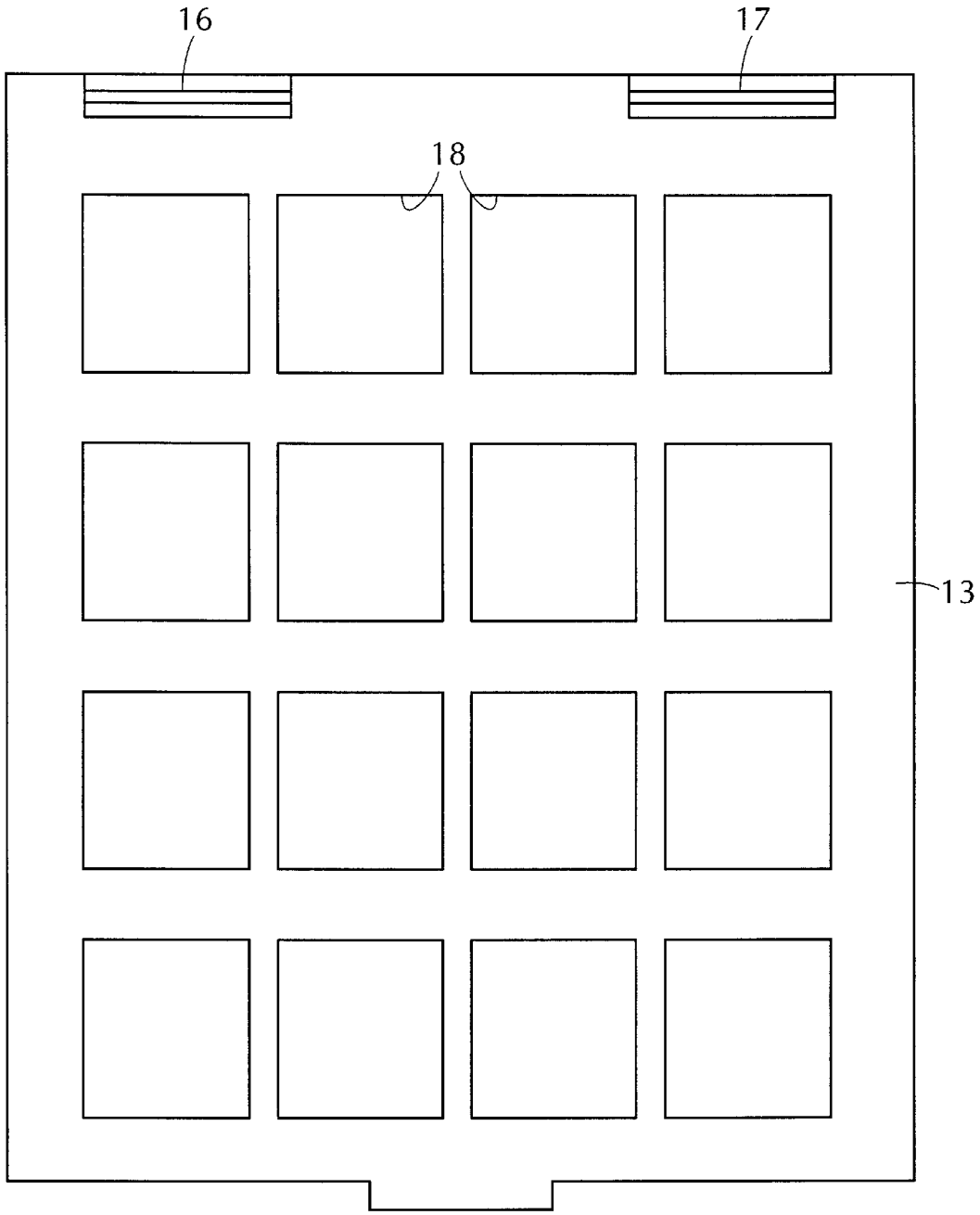
FIG. 3 is a separate view of the frame plate.

The kit shown in FIG. 1 consists of a generally rectangular case molded of synthetic plastic material of high strength, such as polycarbonate or polypropylene to which is hinged a frame plate 13. Thus as shown in FIG. 2, case 12 is provided at its rear end with a pair of notches 14 and 15 in which is received a pair of gudgeons 16 and 17 projecting from the corresponding end of frame plate 13 shown in FIG. 3. Passing through the gudgeons is a pivot pin which serves to hinge the frame plate to the case.

Frame plate 13 is provided with an array of square openings 18 which when the plate is swung down to rest on the upper edge of case 12, then lie in registration with the corresponding array of cosmetic modules 10A to 10P and serve to frame these modules to provide a user with access to the cosmetics stored therein.

Each module (10A to 10P), as shown in FIG. 2, is seated at an assigned site on the base of case 12. Each of these sites is defined by four guide pins P anchored on the base of the case at the corners of a geometric diamond to abut the four sides of the module at their midpoints. The modules in each row, such as modules 10A, 10B, 10C and 10D in the first row of the array are equidistant from each other, the space between the modules being set by the pin that abuts adjacent sides of successive modules and is therefore common to adjacent sites.

Thus to place a module at a given site one has only to drop it into place at the site defined by the four pins. When frame plate 13 is folded down to engage the upper edge of case 12 and is latched thereto by suitable latching means (not shown), the modules in the case which are framed by the openings in the plate are locked in place.

The size of each square opening 18 in frame plate 13 is slightly smaller than the size of the square module 10A etc. underlying the opening, hence the module cannot pass through the opening.

When the cosmetic supply of a particular module in the kit is exhausted, it is a simple matter to replace this module with a fresh module. To do so, frame plate 13 is swung up, the exhausted module is removed from the case and replaced at the same site with a fresh module, the frame plate then being swung down and latched, so that now the fresh module is locked in place.

In practice, instead of a rectangular array of modules as in the kit shown in the figures, the kit may include a long single row of modules or two such rows in parallel. And in order to shield the cosmetic modules when the kit is not in use, it may be provided with a removable cover (not shown).

Second Embodiment

Figure 5:
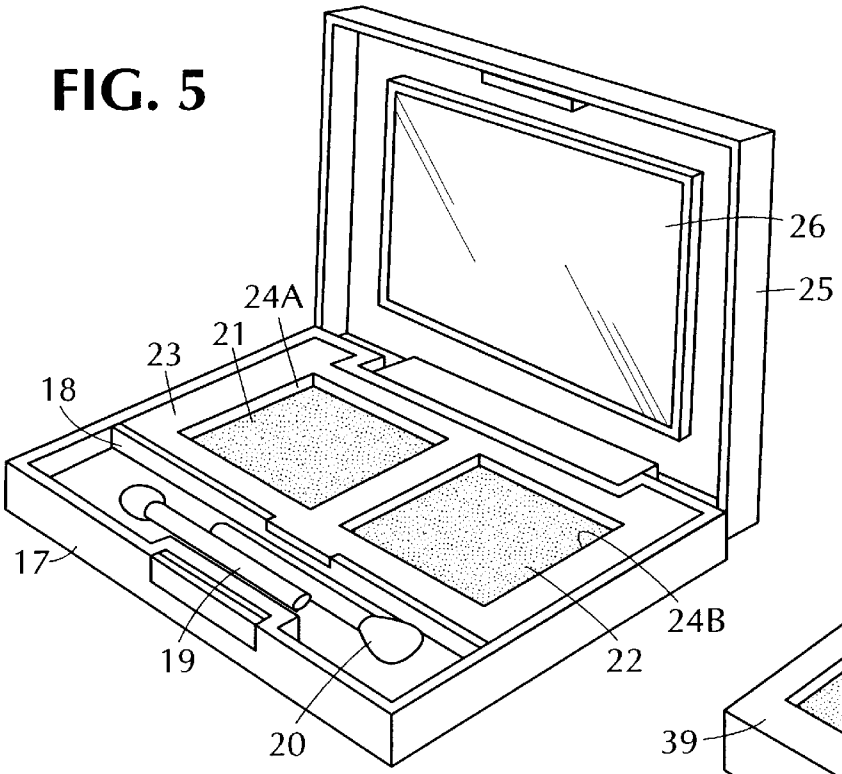
FIG. 5 shows a make-up kit in a compact format containing two cosmetic modules and applicators therefor.

The kit shown in FIG. 1 provides a user with a large number of modules containing an assortment of cosmetics. But when a user wishes to take along in her purse just two make-up cosmetics and applicators therefor, a compact of the type shown in FIG. 5 is suitable for this purpose.

This compact has a rectangular case 17 divided by a transverse ridge 18 into front and rear compartments. The front compartment serves to accommodate small brush applicators 19 and 20 for the cosmetics in the two modules. These modules 21 and 22 are housed in the rear compartment at sites therein defined by guide pins which abut the four sides of the modules, as in the first embodiment.

Figure 6:
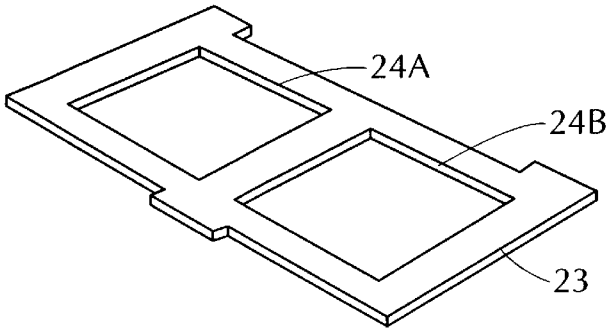
FIG. 6 separately illustrates the frame plate of the compact shown in FIG. 5.

Hinged to the rear end of case 17 is a frame plate 23 having a pair of square openings 24A and 24B (see FIG. 6). These openings register with modules 21 and 22 when the frame plate is swung down to rest on ridge 18. To close the compact when it is not in use, hinged to case 17 is a cover 25 having a mirror 26 mounted on its inner wall.

Thus when the compact is held in one hand of the user with cover open 25, the user is able to apply a cosmetic to her face with an applicator while looking into mirror 26.

To replace an exhausted module, one has only to raise frame plate 23 and substitute for the exhausted module a fresh module which is placed at the same site in the case.

Instead of a compartment for applicators, this compartment can be used to house another pair of cosmetic modules.

Third Embodiment

Figure 7:
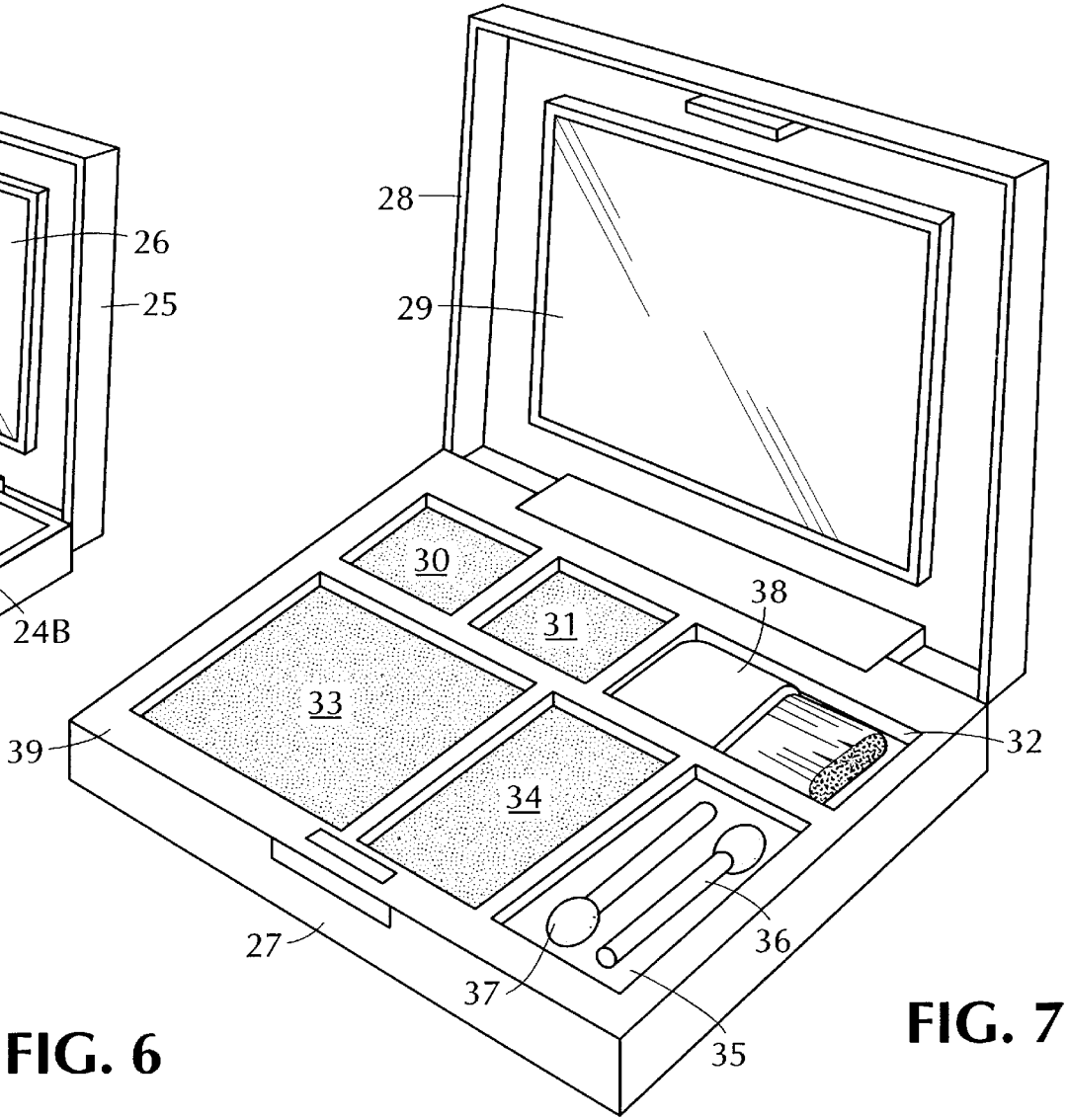
FIG. 7 shows a larger make-up kit in a compact format having four modules of different size, as well as applicators and a brush therefor.

The embodiment of a make-up kit in a compact format shown in FIG. 7 is similar in some respects to that shown in FIG. 5 except that it has a larger rectangular case 27 and a cover 28 hinged thereto having a mirror 29 mounted thereon.

But in this compact, instead of having modules all of the same size as in the other embodiments, the compact houses modules 30 to 35 which differ in rectangular size. Modules 30, 31, 33 and 34 which size have different cosmetics stored therein. Module 35 accommodates two small applicators 36 and 37 while module 32 accommodates a larger brush applicator 38.

Hinged to case 27 is a frame plate 39 provided with rectangular openings of different size that when the frame plate is swung down to lock the modules in the rear compartment then respectively frame the several modules.

To replace any one of the modules, frame plate 39 is raised, and the module pulled out and replaced by a fresh module which is seated at the same site defined by guide pins.

While there has been shown and described preferred embodiments of cosmetic kits with replaceable modules in accordance with the invention, it will be appreciated that many changes may be made thereon without departing from the spirit of the invention.

I claim:

1. A kit housing an assortment of cosmetics comprising:

A. a plurality of miniature rectangular modules, each module having four sides and storing a different cosmetic;

B. a case having spaced sites therein to seat said modules; and

C. a frame plate hinged to said case having a like plurality of rectangular openings which when the frame plate overlies said case the plate then frames the respective modules in the case and holds them in place whereby to replace a module whose cosmetic is exhausted, it is only necessary to raise the frame plate and substitute at the site of the exhausted module a fresh module, each site in the case being defined by guide pins anchored in the case to abut the sides of the module seated at the site, the pins defining said site being a set of four pins at the corners of a diamond, each pin abutting a respective side of the rectangular module at its midpoint.

2. A kit as set forth in claim 1, in which each module is formed by a rectangular metal tray and a cosmetic supply received therein.

3. A kit as set forth in claim 1, in which said modules are in a rectangular array composed of parallel rows of modules, and said frame plate has a corresponding array of openings.

4. A kit as set forth in claim 1, in which each opening in the plate has a size slightly smaller than the size of the module it forms so that the module cannot pass through the opening but is held in the case.

5. A kit as set forth in claim 1, further including at least one module for accommodating a cosmetic applicator.

6. A kit as set forth in claim 5, in which the modules in the plurality vary in size.

7. A kit as set forth in claim 1, in a compact format, further including a cover hinged to the case which when the compact is closed then overlies the frame plate.

8. A module as set forth in claim 7, in which the case is divided into a front compartment for accommodating a cosmetic applicator and a rear compartment for accommodating modules.

* * * * *